US005651704A

United States Patent [19]

Fukushima et al.

[11] Patent Number: 5,651,704

[45] Date of Patent: Jul. 29, 1997

[54] ELECTRICAL CONNECTOR WITH TERMINAL RETAINER

[75] Inventors: Minoru Fukushima, Yokohama; Haruo Hiramoto; Katsutoshi Toujou, both of Machida, all of Japan

[73] Assignee: Molex Incorporated, Lisle, Ill.

[21] Appl. No.: 599,703

[22] Filed: Feb. 9, 1996

[30] Foreign Application Priority Data

Mar. 16, 1995 [JP] Japan ..... 7-084792

[51] Int. Cl.[6] ..... H01R 13/436

[52] U.S. Cl. ..... 439/752; 439/595

[58] Field of Search ..... 439/752, 595, 439/744, 849, 850, 877

[56] References Cited

U.S. PATENT DOCUMENTS

| | | | |
|---|---|---|---|
| 3,693,134 | 9/1972 | Trevisiol | 439/596 |
| 4,017,141 | 4/1977 | Bury et al. | 439/596 |
| 4,679,874 | 7/1987 | Saijo et al. | 439/595 |
| 4,705,337 | 11/1987 | Maeda | 439/595 |
| 4,711,508 | 12/1987 | Sueyoshi | 439/595 |
| 4,750,893 | 6/1988 | Sueyoshi | 439/596 |
| 4,753,612 | 6/1988 | Betsui | 439/596 |
| 4,767,361 | 8/1988 | Hoshino et al. | 439/596 |
| 4,867,705 | 9/1989 | Yuasa | 439/595 |
| 4,867,712 | 9/1989 | Kato et al. | 439/752 |
| 4,946,399 | 8/1990 | Kawashima | 439/752 |
| 4,979,913 | 12/1990 | Aiello et al. | 439/596 |
| 5,120,269 | 6/1992 | Endo et al. | 439/752 |
| 5,160,283 | 11/1992 | Fry et al. | 439/752 |
| 5,167,534 | 12/1992 | Ohsumi | 439/595 |
| 5,189,788 | 3/1993 | Sakai et al. | 29/842 |
| 5,205,763 | 4/1993 | Watanabe et al. | 439/752 |
| 5,209,676 | 5/1993 | Endo et al. | 439/595 |
| 5,252,095 | 10/1993 | Brietschaft et al. | 439/752 |
| 5,252,096 | 10/1993 | Okada | 439/752 |
| 5,281,168 | 1/1994 | Krehbiel et al. | 439/595 |
| 5,292,262 | 3/1994 | Endo et al. | 439/752 |
| 5,299,958 | 4/1994 | Ohsumi | 439/752 |
| 5,316,504 | 5/1994 | Jinno | 439/752 |
| 5,378,176 | 1/1995 | Sasai | 439/752 |
| 5,437,565 | 8/1995 | Atsumi et al. | 439/752 |

*Primary Examiner*—Neil Abrams
*Assistant Examiner*—T. C. Patel
*Attorney, Agent, or Firm*—Stephen Z. Weiss

[57] ABSTRACT

An electrical connector includes a housing having a plurality of generally parallel elongated terminal-receiving cavities. An opening is formed in a side wall of the housing intersecting the cavities and communicating therewith. A plurality of elongated terminals are insertable into the cavities. Each terminal includes a latching projection. A terminal retainer is positionable in the opening in a direction transverse to the cavities. The retainer includes a plurality of elongated ribs projecting into the cavities and engaging the elongated terminals. At least certain ends of the elongated ribs include camming surfaces for engaging the latching projections on the terminals and moving the terminals to fully inserted positions in the event that the terminals are in only partially inserted positions.

9 Claims, 15 Drawing Sheets

ELECTRICAL CONNECTOR WITH TERMINAL RETAINER

FIELD OF THE INVENTION

This invention generally relates to the art of electrical connectors and, particularly, to an electrical connector having a retainer for latching or locking terminals in proper position within the connector.

BACKGROUND OF THE INVENTION

A typical electrical connector includes a dielectric housing having a plurality of terminal-receiving cavities. A plurality of terminals are received in the cavities. Often, the cavities are generally parallel and elongated, and the terminals also are elongated and inserted into the cavities along longitudinal axes. The housing may have primary latch means, such as flexible latch arms, for holding the terminals in their fully inserted positions.

Some electrical connectors include terminal retainers for holding the terminals in their cavities, sort of as a secondary latch means. The terminal retainer may even include a provision for moving the terminals from a partially inserted position to their fully inserted positions in response to mounting the retainer onto or into the connector housing.

One example of an electrical connector which employs a terminal retainer is shown in Japanese Utility Model Application Laid-Open No. 1-177875. As shown therein, a terminal retainer is inserted into an elongated opening in one side wall of the housing, the elongated opening traversing the longitudinal axis of each terminal. However, if one or more terminals are not fully inserted into their cavities, the retainer cannot be mounted to the housing, whereby the retainer might act as a terminal position assurance device, but the retainer cannot move the terminals to their fully inserted positions. Which terminal or terminals are only partially inserted must be determined by sight, and such determination is inefficient and not cost effective.

Another example of an electrical connector employing a terminal retainer is shown in Japanese Utility Model Applications Laid-Open Nos. 6-17135 and 6-36235. As shown therein, the terminal retainer can correct or fully insert partially inserted terminals. However, the retainer can be slipped off of the housing when forces are applied to the terminal.

Another problem with prior art connectors having terminal retainers, as described above, is that it is difficult to determine the alignment of the retainers for positioning in their openings in the connector housings. In other words, the retainers are not symmetrical in any given direction, and an operator must figure out the particular orientation of the retainer before the retainer can be assembled to the housing. This also is inefficient and not cost effective.

The present invention is directed to solving the above problems and providing a much more efficient and cost effective electrical connector having a terminal retainer, than has been available in the prior art.

SUMMARY OF THE INVENTION

An object, therefore, of the invention is to provide a new and improved electrical connector having a terminal retainer, of the character described.

In the exemplary embodiment of the invention, the electrical connector includes a housing having a plurality of generally parallel elongated terminal-receiving cavities. An opening is formed in a side wall of the housing intersecting the cavities and communicating therewith. A plurality of generally elongated terminals are insertable into the cavities. Each terminal includes a latching projection. A terminal retainer is positionable in the opening in a direction transverse to the cavities. The retainer includes a plurality of elongated ribs projecting into the cavities and engaging the elongated terminals. Ends of the elongated ribs have camming surfaces for engaging the latching projections on the terminals and moving the terminals to fully inserted positions in the event that the terminals are in only partially inserted positions. Complementary interengaging locking means are provided between the terminal retainer and the housing to lock the retainer in the opening.

According to an aspect of the invention, the opening in the housing and the terminal retainer are elongated in a direction transverse to the elongated cavities and terminals. The terminal retainer is symmetrical in the longitudinal direction to allow the retainer to be positioned in the opening regardless of the longitudinal orientation of the retainer.

As disclosed herein, the ends of the elongated ribs are rounded to present curved camming surfaces for engaging the latching projections on the terminals. The latching projections are triangulated to present oblique surfaces for engaging the curved camming surfaces.

In addition, the housing includes a primary latch engageable with a latch surface on each terminal, whereby the latching projections and the camming surfaces comprise secondary latch means. The primary latch and latch surface are on a side of each terminal opposite the respective latching projection and camming surface, whereby each rib is effective to bias the respective terminal toward the primary latch. As disclosed herein, the primary latch comprises a flexible latch arm cantilevered into a respective terminal-receiving cavity.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
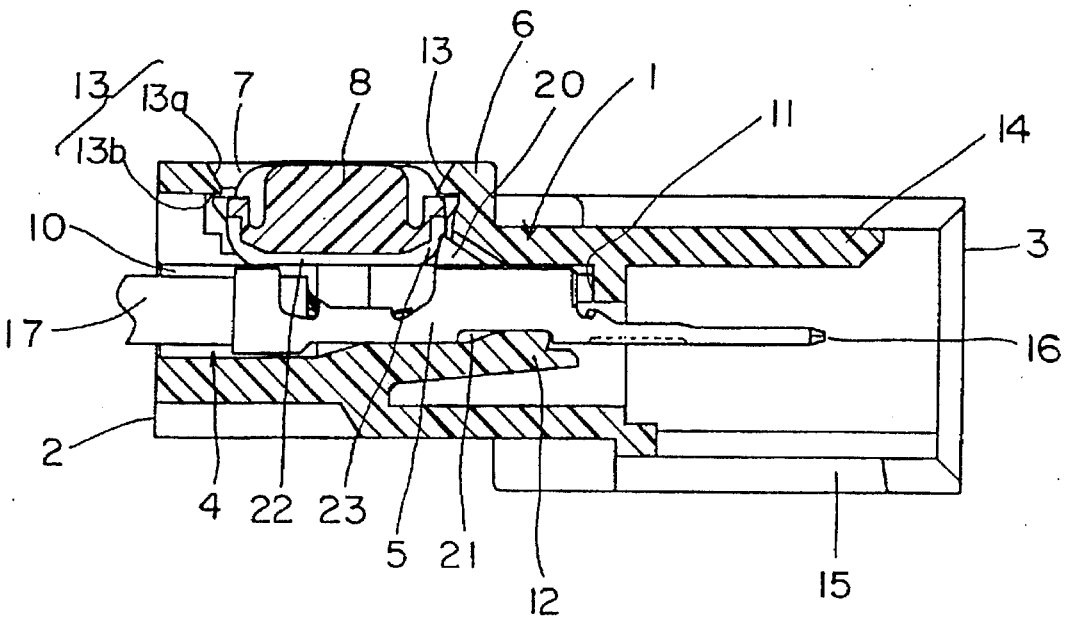
FIG. 1 is an axial section through and electrical connector according to a first embodiment of the invention.

Referring to the drawings in greater detail, FIGS. 1–13 show an electrical connector according to a first embodiment of the invention. The connector includes a housing, generally designated 1, unitarily molded of dielectric material such as plastic or the like. Six male terminals 5 are inserted into respective terminal-receiving cavities 10 which extend from a rear face 2 to a front face 3 of the housing. A terminal retainer 8 is fitted into a rectangular, elongated opening 7 formed in a top wall 6 of housing 1. The terminal-receiving cavities 10 are generally parallel and elongated, and opening 7 intersects the cavities and communicates with the cavities.

Figure 9:
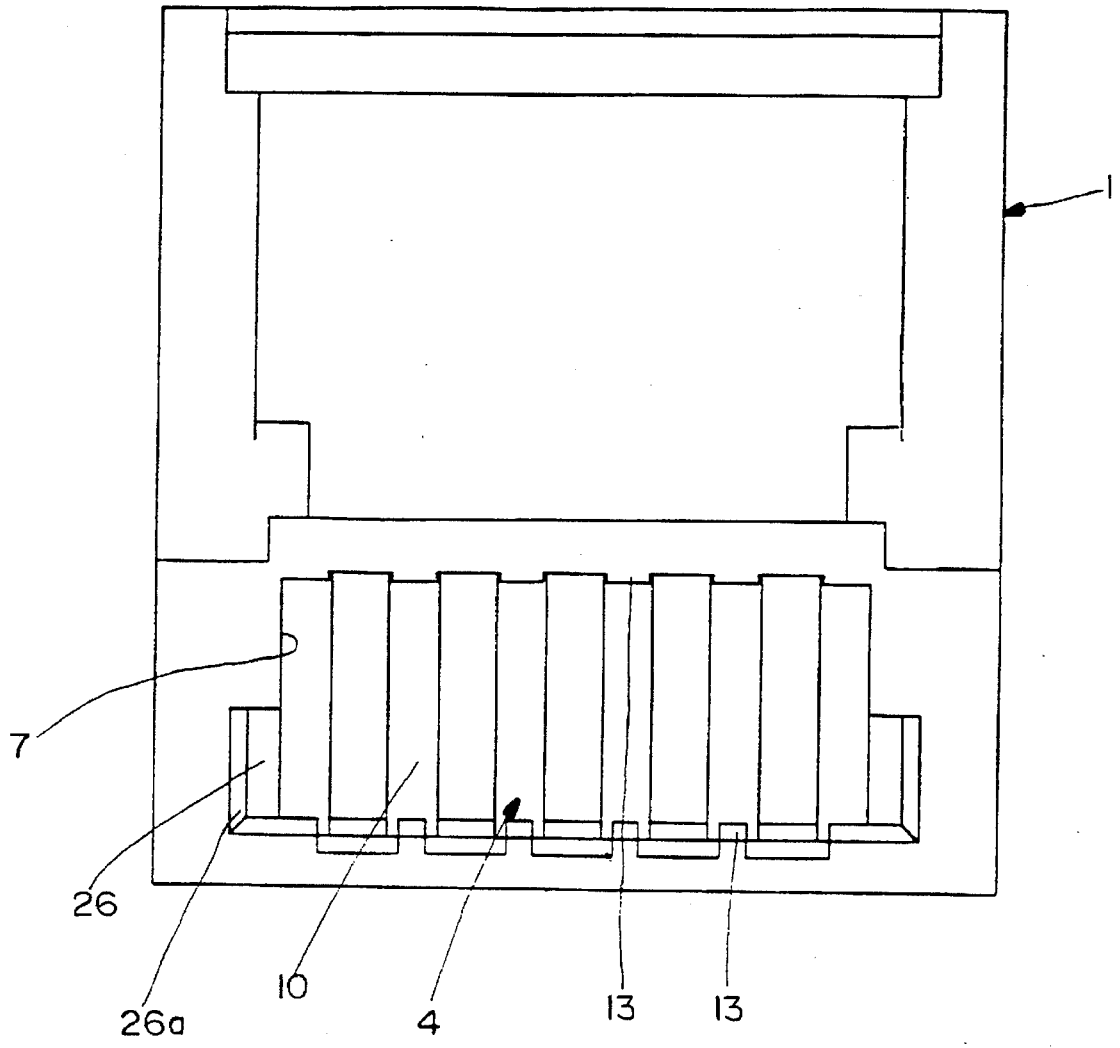
FIG. 9 is a top plan view of the connector housing with the terminal retainer removed.
Figure 10:
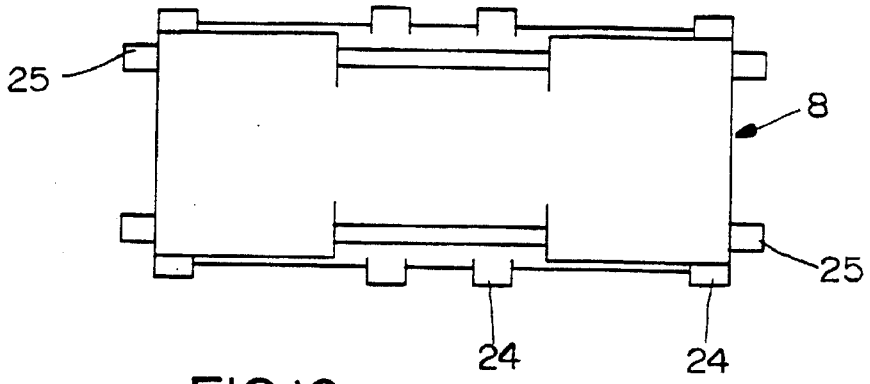
FIG. 10 is a top plan view of the terminal retainer.
Figure 11:
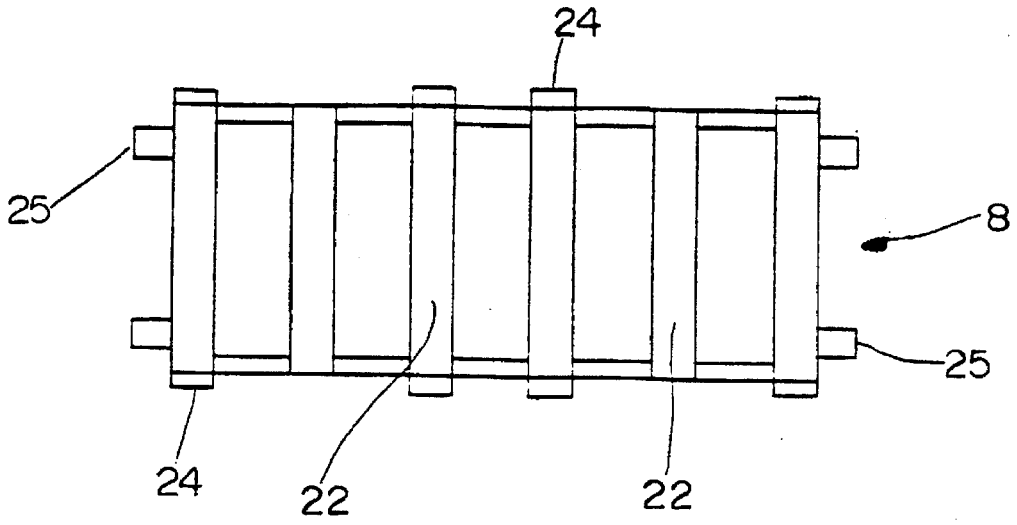
FIG. 11 is a bottom plan view of the terminal retainer.
Figure 12:
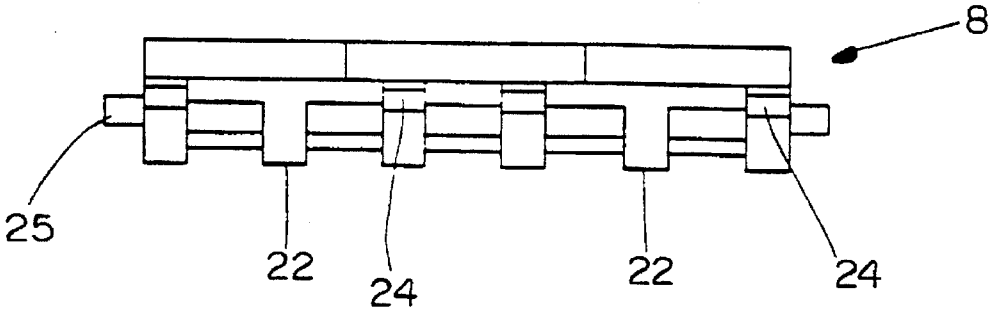
FIG. 12 is a front elevational view of the terminal retainer.
Figure 13:
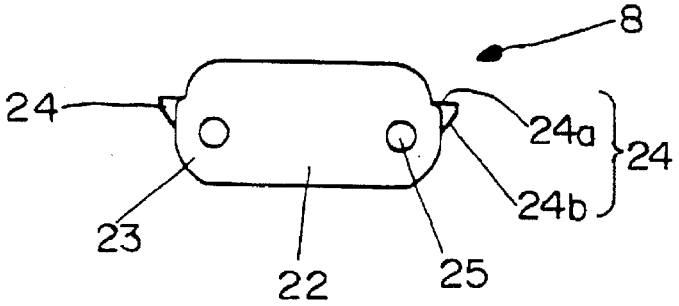
FIG. 13 is a side elevational view of the terminal retainer.

As shown in FIGS. 4–9, housing 1 is relatively thin, hollow and of a rectangular configuration in cross-section (i.e. transverse to cavities 10), the six cavities being defined by "T" cross-sectioned walls 9. Each cavity 10 has an abutment surface 11 (see FIG. 2) and a primary latch arm 12 intermediate the ends of the cavity and cantilevered into the cavity. Elongated rectangular opening 7 can be seen to be closer to rear face 2 of the housing, intersecting the entire parallel arrangement of terminals 5. All cavities 10 communicate with opening 7, as best seen in FIG. 9. The opposite, long sides of elongated rectangular opening 7, which are parallel to the front and rear faces 3 and 2, respectively, of the housing, have tapering engagement projections 13 which cantilever into opening 7, each projection having an inclined surface 13*a* and a flat bottom surface 13*b*. The housing has a mating end 14 for mating with a complementary connector (not shown) having female terminals which mate with male terminals 5. The housing has a rectangular opening 15 in its bottom wall for latching with a front latch of the mating connector.

Figure 2:
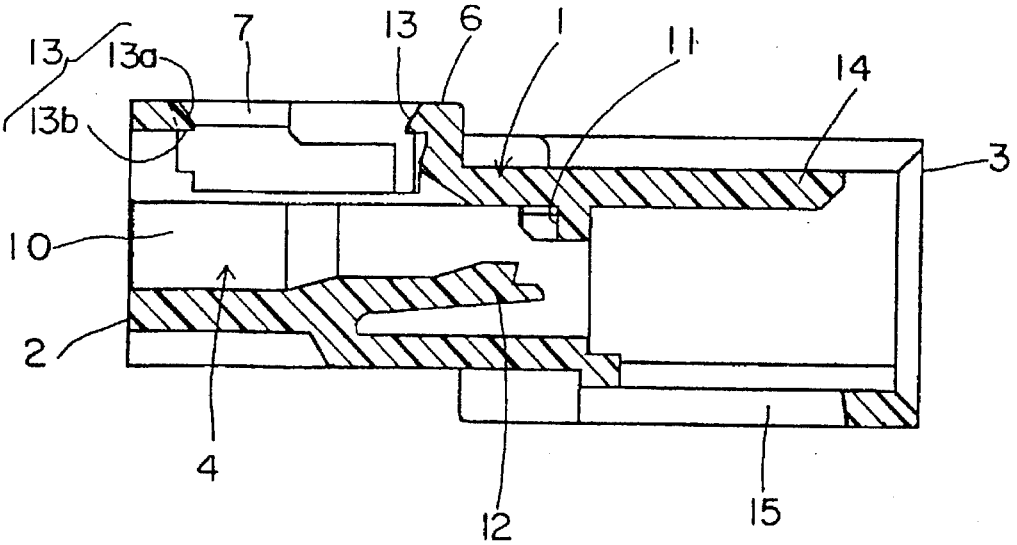
FIG. 2 is an axial section through the housing of the electrical connector of FIG. 1.
Figure 3:
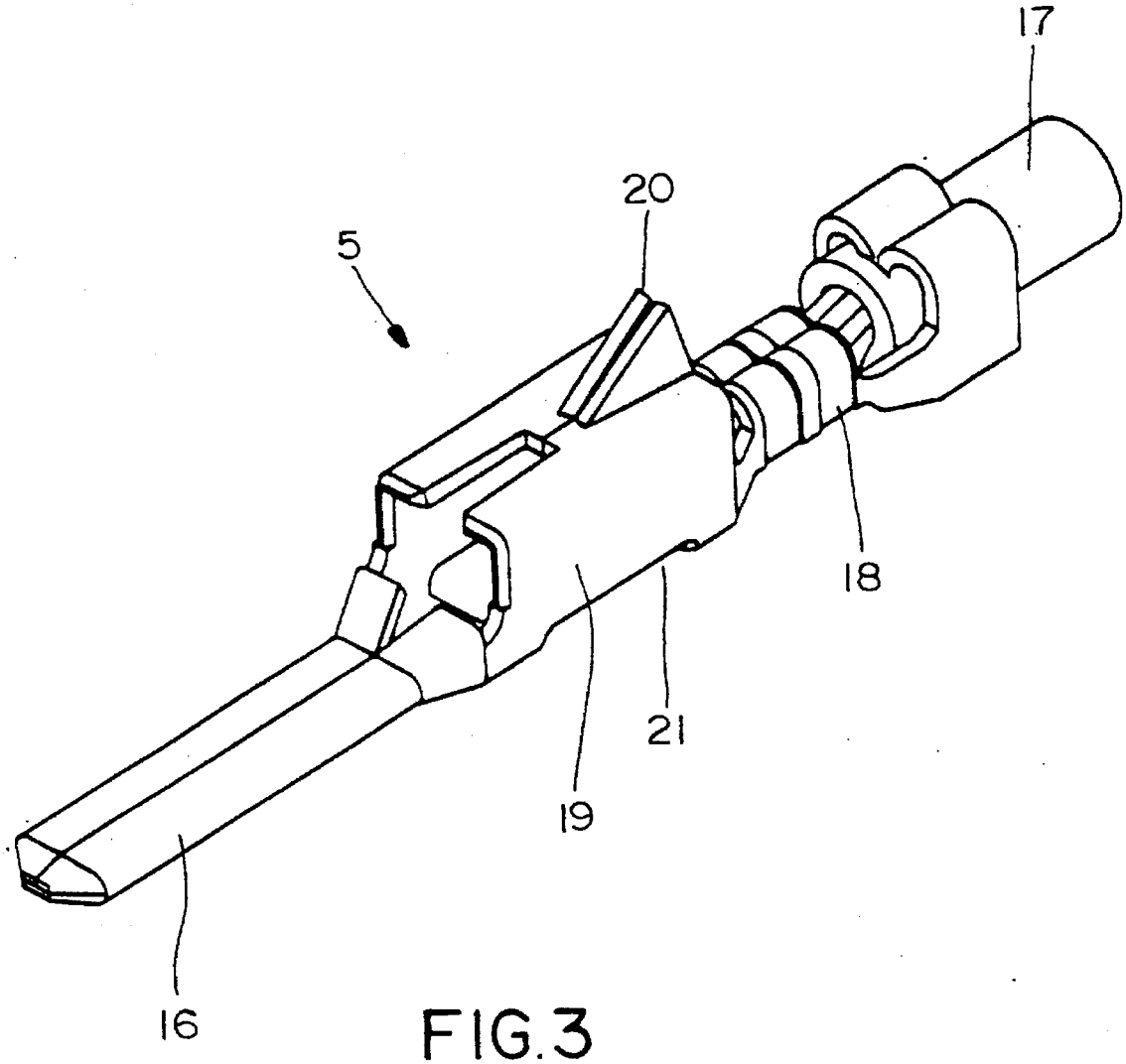
FIG. 3 is a perspective view of the male terminal used in the connector of FIG. 1.
Figure 4:
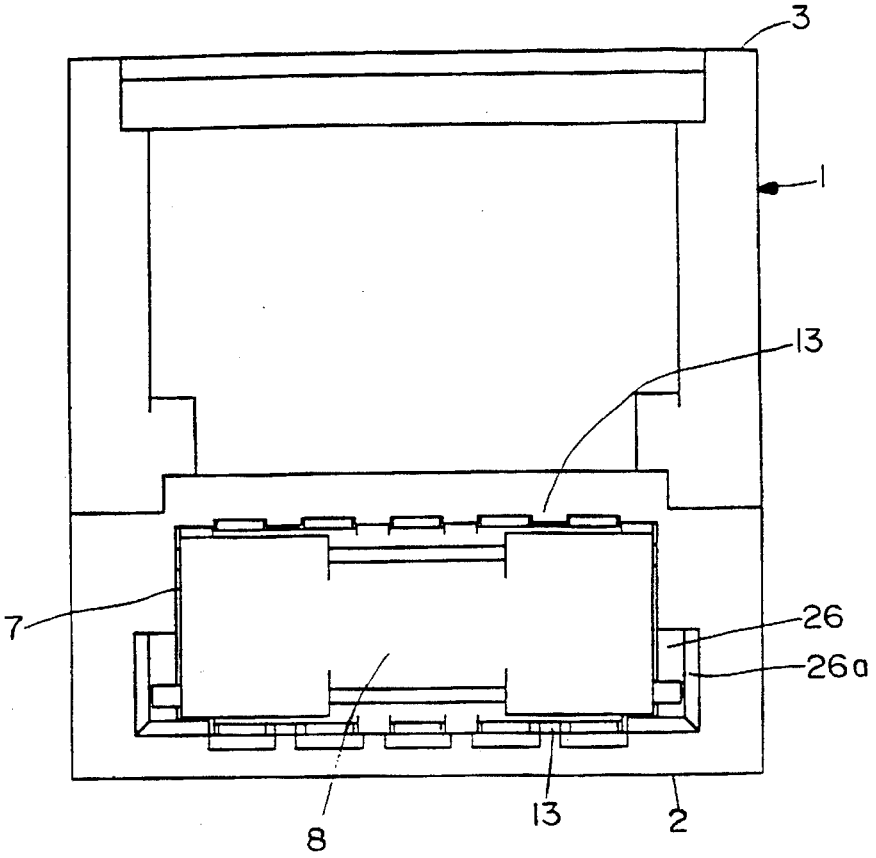
FIG. 4 is a top plan view of the connector.
Figure 5:
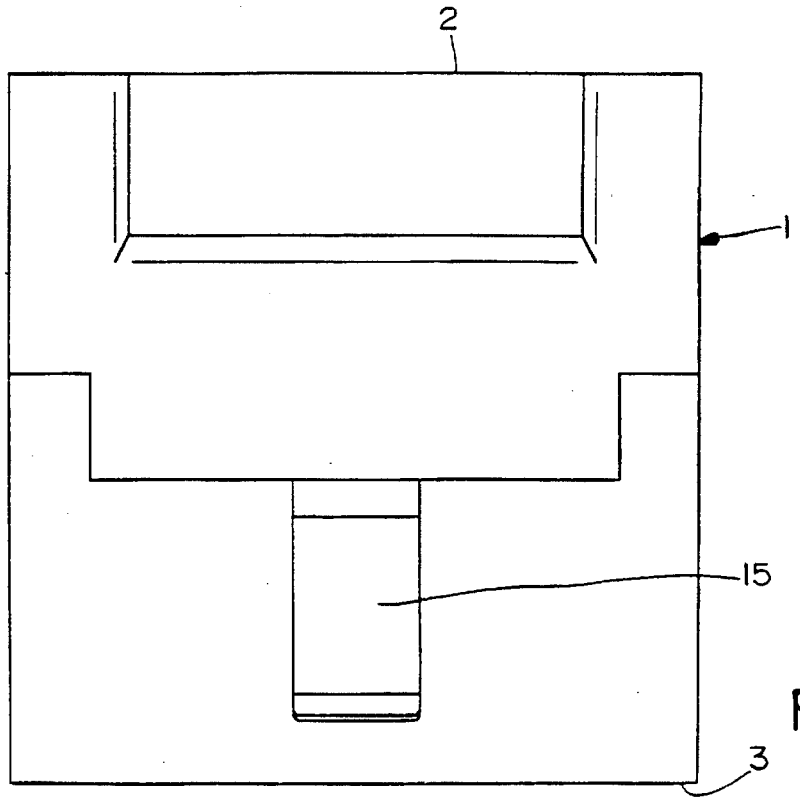
FIG. 5 is a bottom plan view of the connector.
Figure 6:
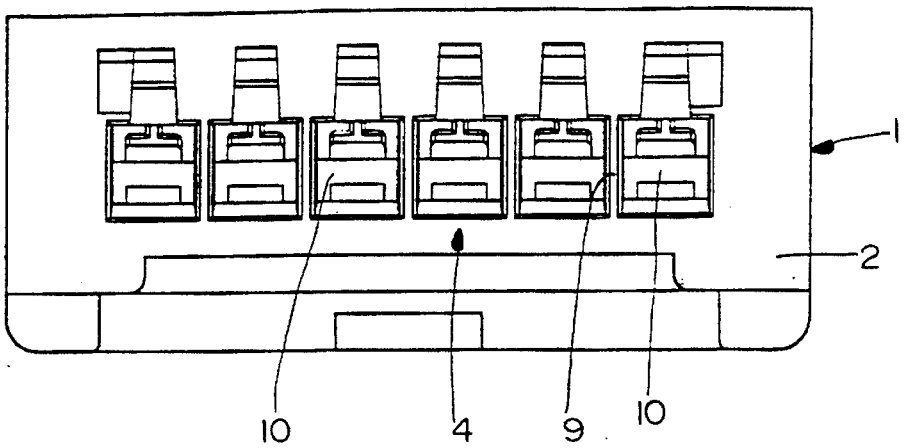
FIG. 6 is a front elevational view of the connector.
Figure 7:
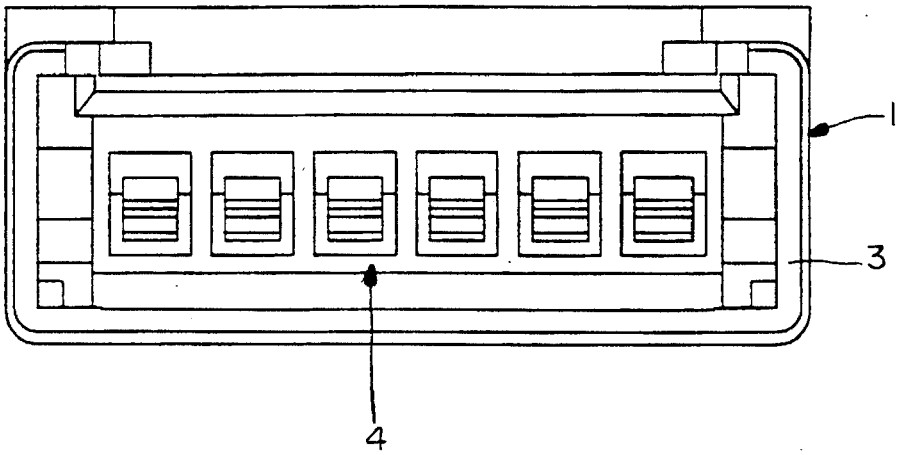
FIG. 7 is a rear elevational view of the connector.
Figure 8:
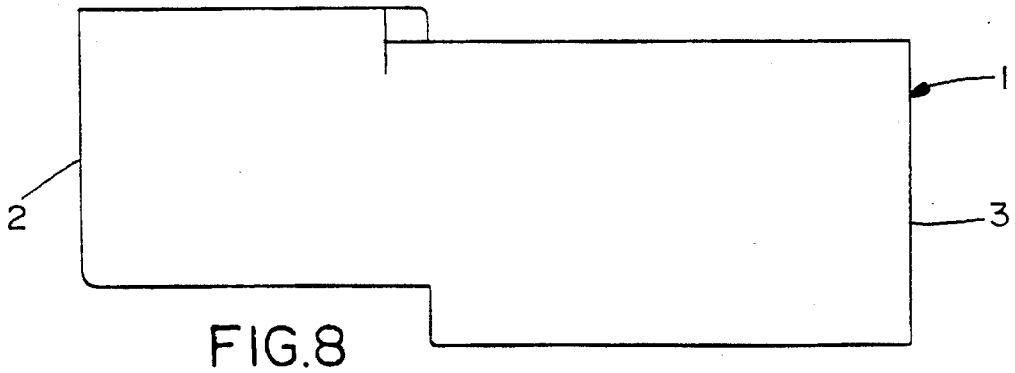
FIG. 8 is a side elevational view of the connector.

As shown in FIGS. 1–3, male terminal 5 has a mating pin 16 at its front end and a wire terminating portion 18 at its rear end. The terminal has a hollow rectangular body 19 between the mating pin 16 and the terminating portion 18. The hollow rectangular body 19 has a triangulated latching projection 20 integrally connected to the top thereof and a notched section 21 at the bottom thereof. The notched section is engageable with primary latch arm 12 of the housing when the male terminal is fully inserted into its respective cavity 10.

Specifically, when inserting one of the male terminals 5 into an inlet 4 of a respective cavity 10 in housing 1, mating pin 16 pushes the primary latch arm 12 down, thereby causing the latch to resiliently bend. The resilient latch arm returns to its original position shown in FIGS. 1 and 2 when the male terminal is fully inserted into its respective cavity 10, whereby its notched section 21 at the bottom of the terminal aligns with the cantilevered latch arm and allows the latch arm to snap into the notched section 21.

Retainer 8 is assembled into opening 7 in housing 1 after inserting all male terminals 5 into the housing. As seen in FIGS. 10–13, the retainer is a unitary structure which may be integrally molded of dielectric material such as plastic or the like. The retainer is similar to the shape and size of elongated rectangular opening 7 in top wall 6 of the housing and has a plurality of ribs integrally molded with its lower surface. These ribs are arranged at the same spacing as terminal-receiving cavities 10 in the housing, so that the ribs are positioned in alignment with the triangulated fastening projections 20 of the male terminals when the retainer is positioned into opening 7 of the housing. Each rib 22 has a curved camming surface 23 at each opposite end of the rib. The front camming surface 23 of the retainer is engageable with the triangular latching projection 20 of a respective one of the male terminals.

In addition, terminal retainer 8 has a plurality of triangular projections 24 on its opposite longitudinal edges. Each triangular projection 24 includes a flat top surface 24*a* and a downwardly inclined surface 24*b*. These triangular projections 24 are arranged on the opposite longitudinal edges of retainer 8 so that they are alignable with projections 13 in the rectangular elongated opening 7 in the top wall 6 of the housing for engagement when retainer 8 is mounted in the opening.

Still further, terminal retainer 8 has a plurality of extensions 25 at each of its short opposite edges or ends. These extensions 25 will engage within recesses 26 at the opposite short sides of rectangular opening 7 in the top wall of the housing. Each recess 26 has a chamfered guide surface 26*a* to guide extensions 25 into recesses 6.

As mentioned earlier, retainer 8 is mounted to housing 1 after inserting all male terminals 5 into their respective cavities 10. The retainer is positioned into elongated opening 7 with the front triangular projections 24 of the retainer snap-fit under the complementary triangular projections 13 of the housing, so that the flat upper surfaces 24 of triangular projections 24 confront the flat lower surfaces 13*b* of projections 13. The retainer is pushed downwardly into opening 7 in a direction transverse to elongated cavities 10.

When terminal retainer 8 is assembled to housing 1 through opening 7, ribs 22 at the bottom of the retainer push the underlying male terminals 5 against resilient primary latch arm 12. At the same time, front camming surfaces 23 are positioned for engagement with triangular latching projections 20 of the male terminal. The latching of resilient latch arms 12 into notched sections 21 of the male terminals prevent the terminals from being pulled back out of their respective cavities 10. However, even if some of the terminals are not quite fully inserted into the cavities, curved camming surfaces 23 at the front of ribs 22 will engage triangular latching projections 20 of any partially inserted terminals and push the terminals to their fully inserted positions, as ribs 22 at the bottom of the retainer pushed down on the terminals to more effectively align and position the terminals. Of course, the terminals must be inserted at least to an extent where front camming surfaces 23 of ribs 22 can engage triangular latching projections 20, before the terminals can be pushed to their fully inserted positions.

With the above arrangement, all male terminals 5 are locked against being pulled back out of their respective cavities in the housing. Terminal retainer 8 can be easily mounted within opening 7 of the housing, providing alignment and full insertion of the terminals through camming surfaces 23 and ribs 22.

According to another aspect of the invention, it can be seen particularly in FIGS. 10–13 that the elongated rectangular retainer 8 is symmetrical in its longitudinal direction. That includes having rounded camming surfaces 23 at both opposite ends of each rib 22. Therefore, the retainer can be positioned into opening 7 regardless of the longitudinal orientation of the retainer. This greatly facilitates ease of assembly of the connector and provides efficiency during processing of the connector, resulting in a very cost-effective assembly operation.

Figure 14:
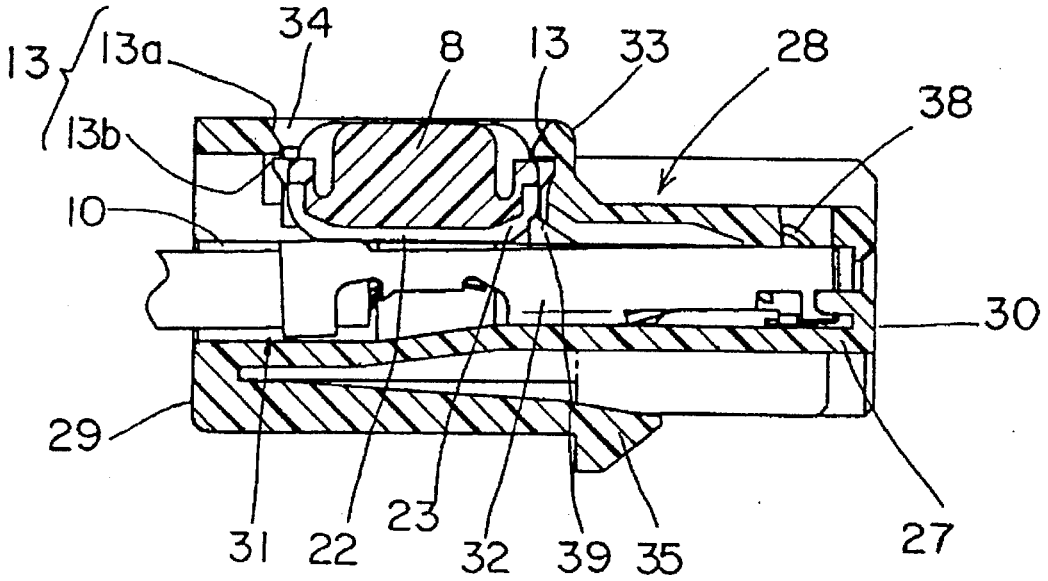
FIG. 14 is an axial section through an electrical connector according to a second embodiment of the invention.

FIGS. 14–22 show an eight-pole electrical connector according to a second embodiment of the invention. The connector has components common to the components of the electrical connector of the first embodiment, and such common components are indicated by the same reference numerals as applied in FIGS. 1–13. As seen in FIG. 14, the eight-pole connector has eight female terminals 32 inserted into cavities 10 in a rectangular housing 28. The housing has legs 27 extending into the cavities. A retainer 8 is positioned into a rectangular opening 34 in a top wall 33 of the housing.

As shown in FIGS. 17–22, housing 28 has a center latch plate 35 at the bottom of the housing, extending from a rear face 29 of the housing toward a front face 30 of the housing. When the housing is assembled to mating end 14 of housing 1 of the connector shown in FIG. 1, center latch plate 34 of housing 28 is locked by the bottom opening 15 of housing 1.

Figure 15:
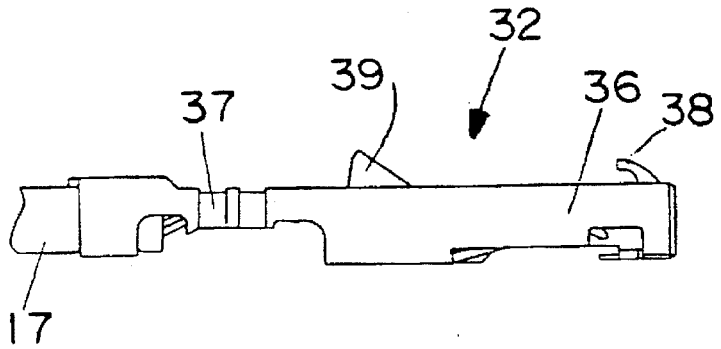
FIG. 15 is a side elevational view of a female terminal used in the electrical connector of FIG. 14.
Figure 16:
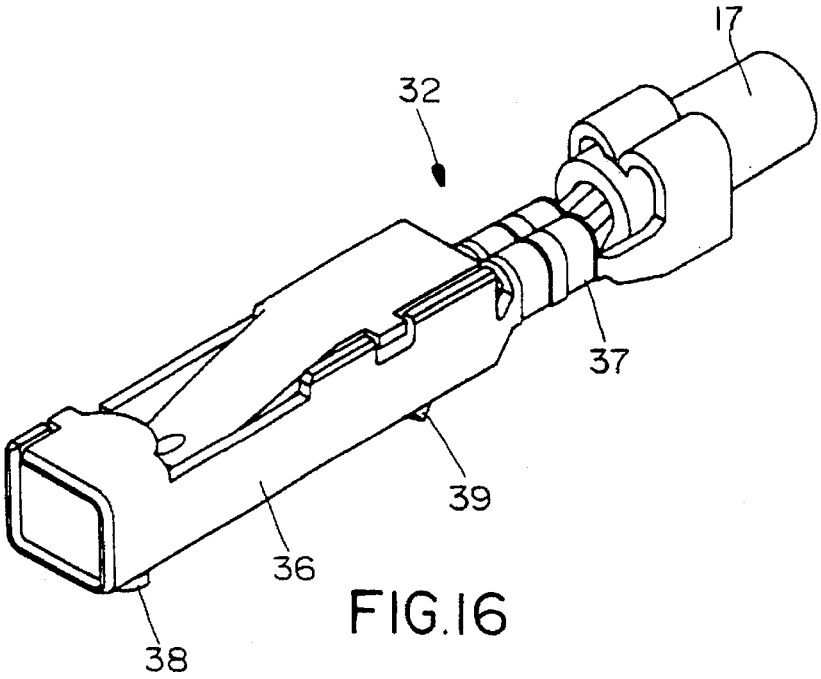
FIG. 16 is a perspective view of the female terminal of FIG. 15.
Figure 17:
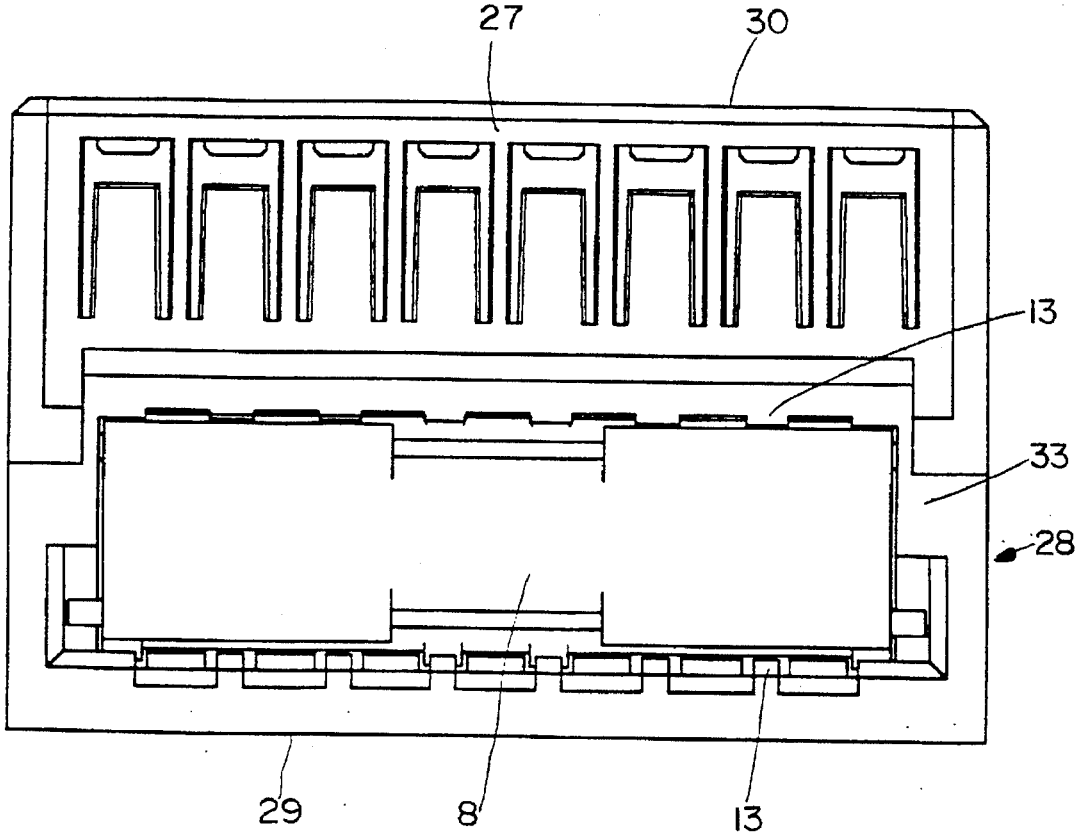
FIG. 17 is a top plan view of the connector of FIG. 15.
Figure 18:
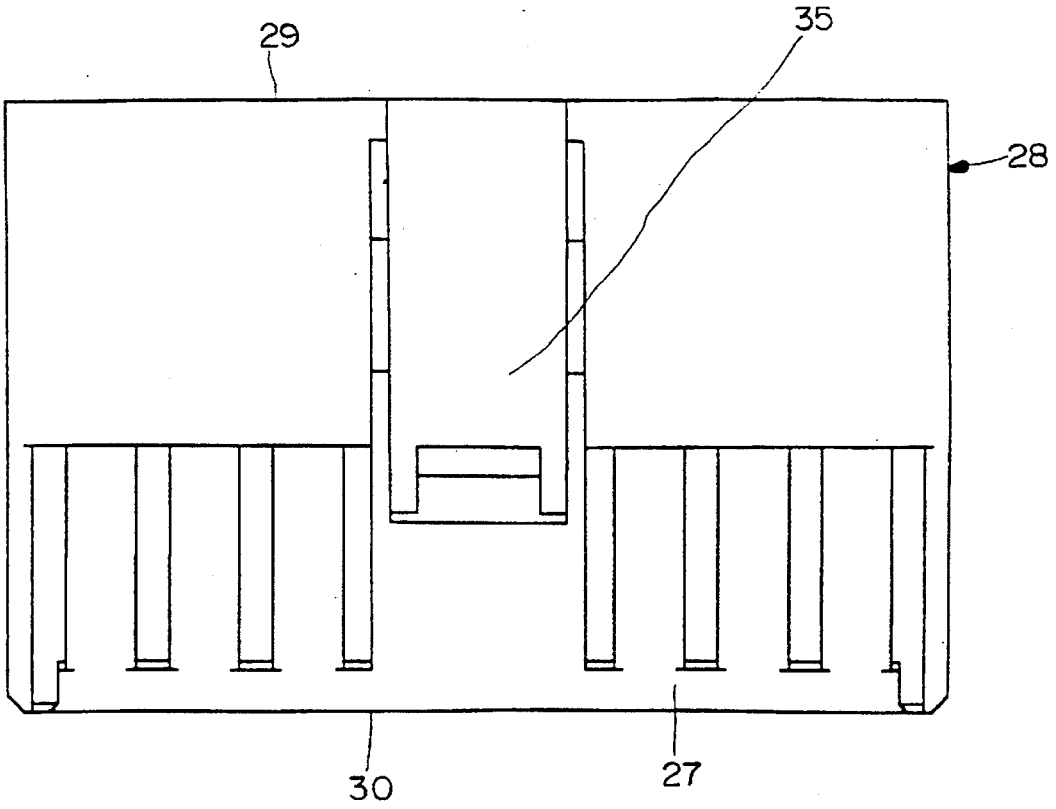
FIG. 18 is a bottom plan view of the connector.
Figure 19:
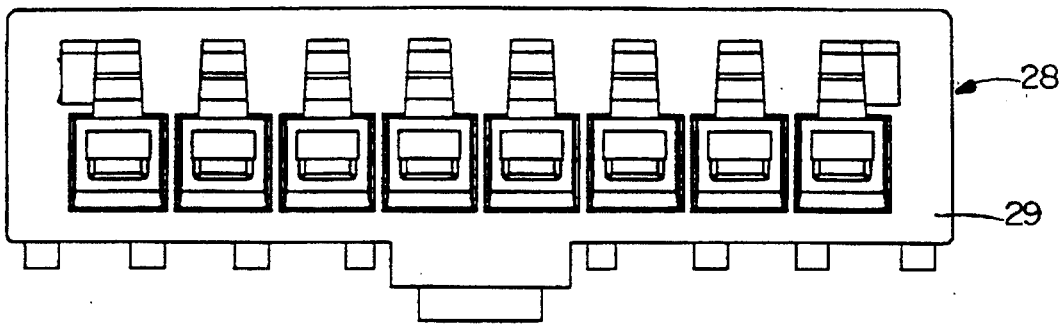
FIG. 19 is a front elevational view of the connector.
Figure 20:
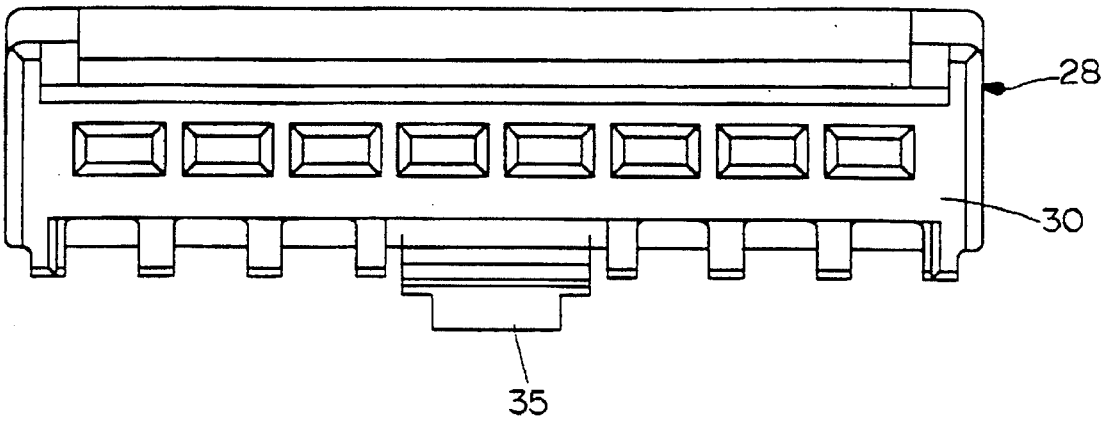
FIG. 20 is a rear elevational view of the connector.
Figure 21:
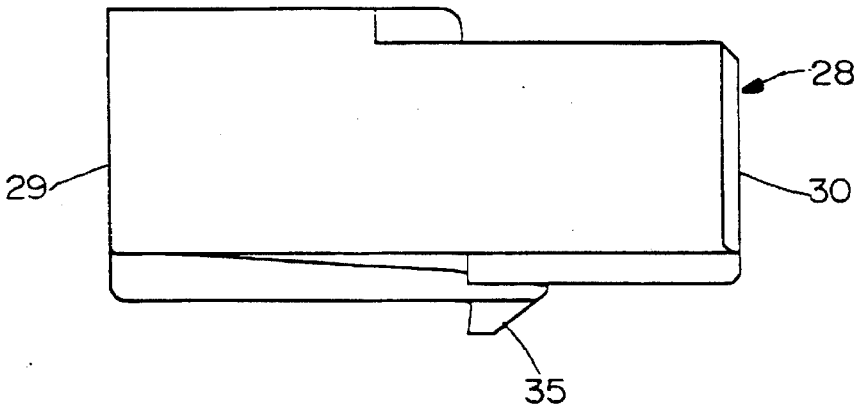
FIG. 21 is a side elevational view of the connector.
Figure 22:
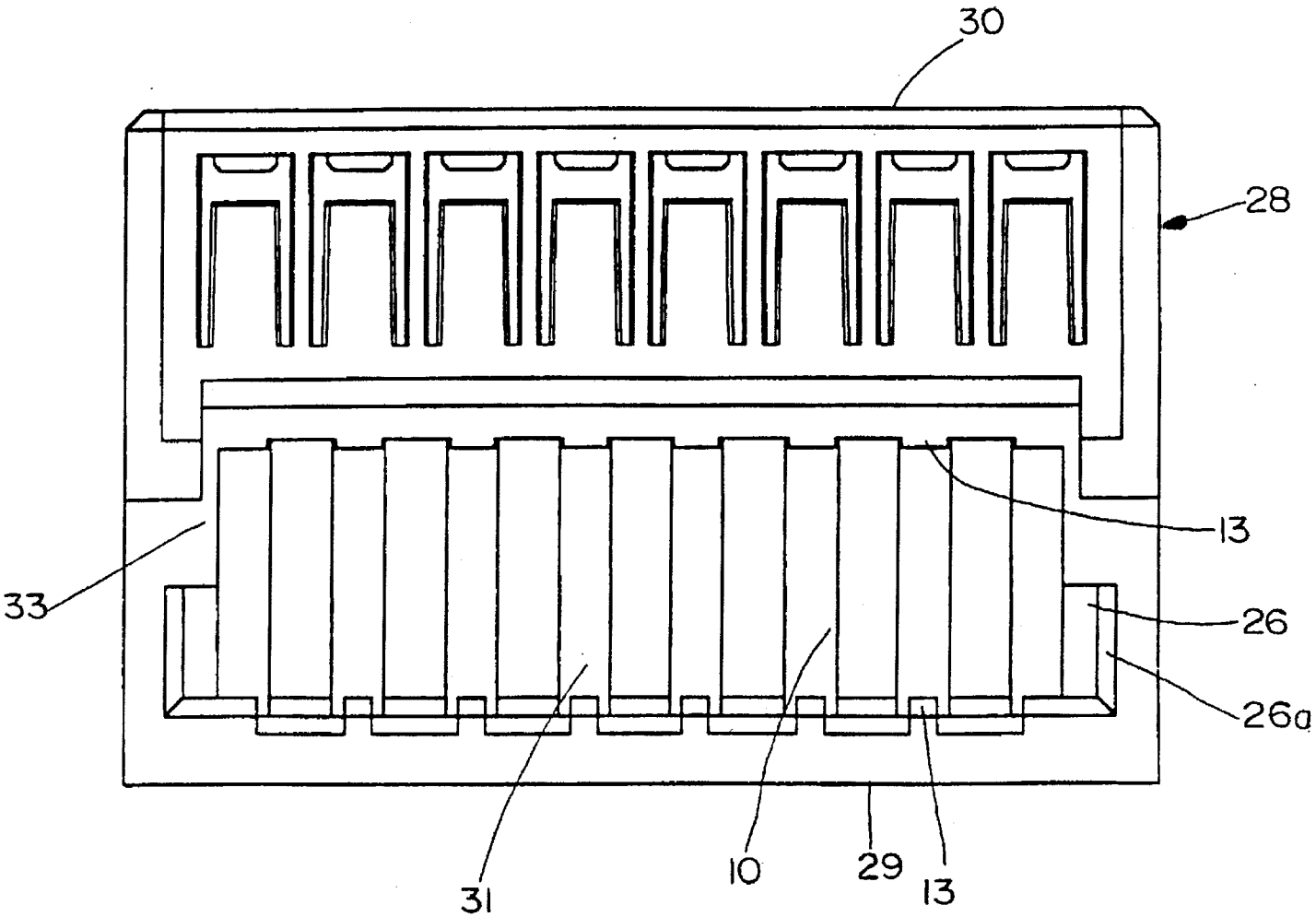
FIG. 22 is a top plan view of the connector housing of the embodiment of FIG. 15, with the terminal retainer removed.
Figure 23A:
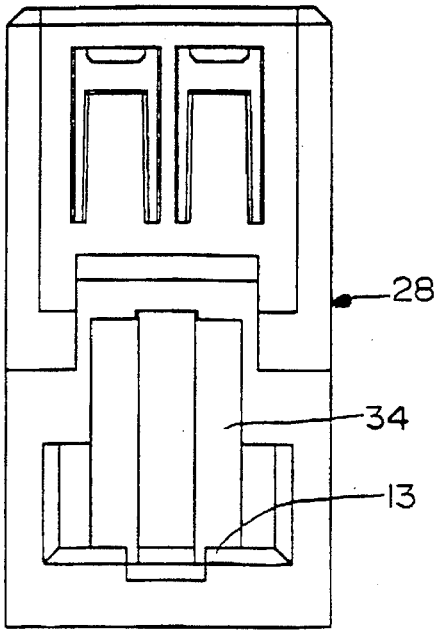
FIGS. 23(*a*)–(*d*) are top plan, bottom plan, front elevational and rear elevational views, respectively, of an electrical connector according to a third embodiment of the invention.
Figure 23B:
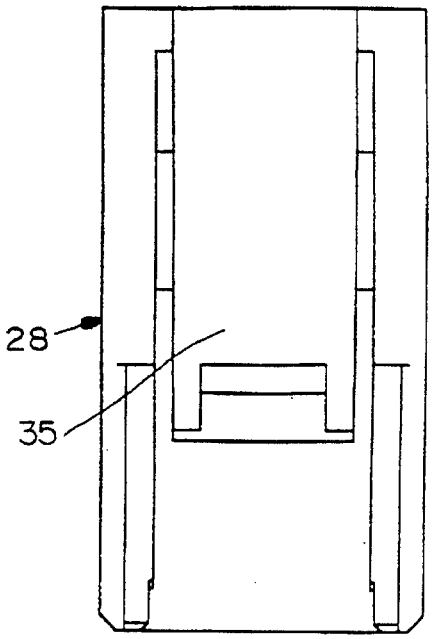
Figure 23C:
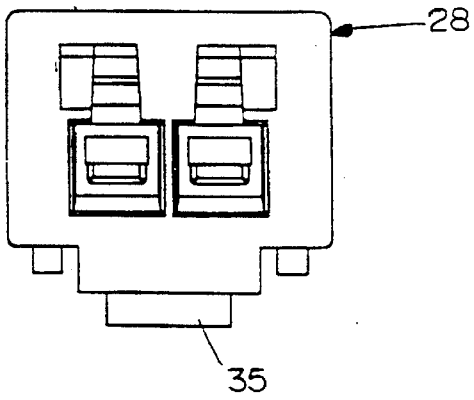
Figure 23D:
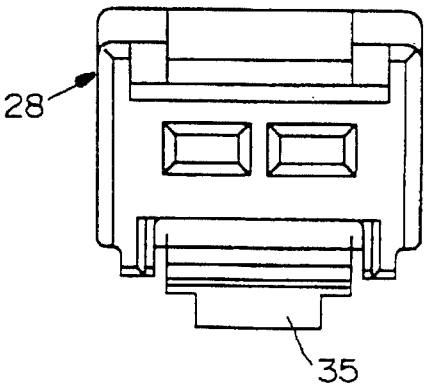
Figure 24A:
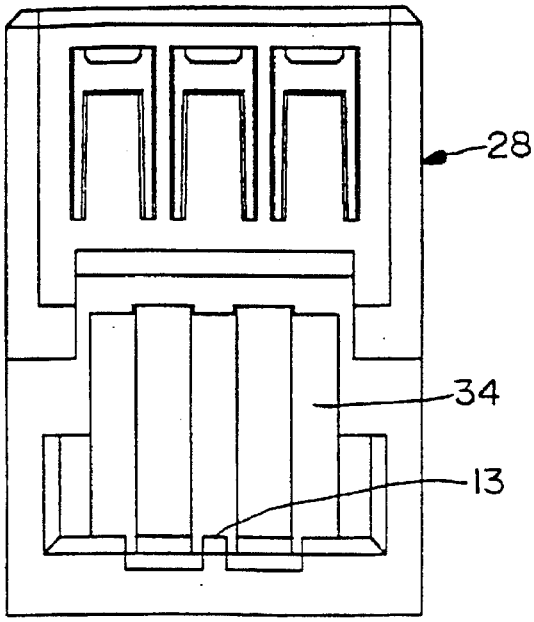
FIGS. 24(*a*)–(*d*) are top plan, bottom plan, front elevational and rear elevational views, respectively, of an electrical connector according to a fourth embodiment of the invention.
Figure 24B:
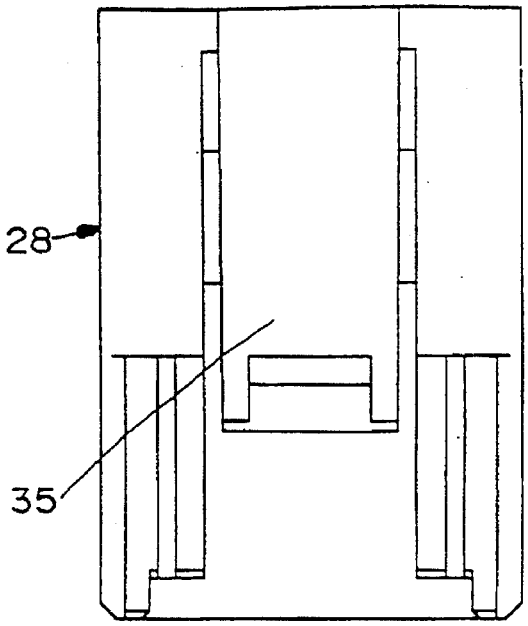
Figure 24C:
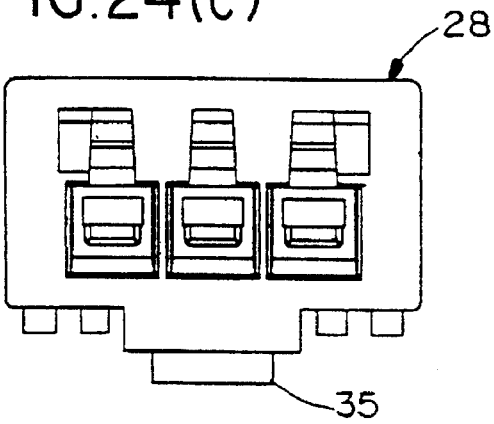
Figure 24D:
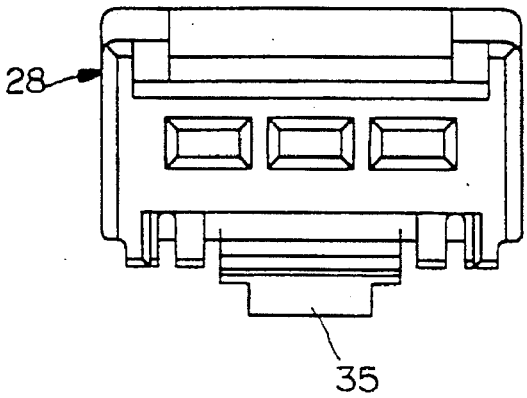

As seen in FIGS. 14–16, female terminal 32 has a mating end 36 for receiving pin 16 of male terminal 5, along with a wire terminating end 37. Mating end 36 is generally hollow and rectangular and has a curved projection 38 at its front end for latching in a recess at the front of housing 28, along with a triangular latching projection 39 for engaging the camming surface 23 of a respective one of the ribs 22 of retainer 8.

After inserting all female terminals 32 into housing 28, retainer 8 is positioned into rectangular opening 34 in top wall 33 of the housing. Ribs 22 of the retainer push the female terminal downwardly, and camming surfaces 23 of the ribs engage triangular latching projections 39 of the female terminals to provide a secondary latching means in cooperation with the engagement of front curved projections 38 of the female terminals with the housing near the front end of the housing. As is the case with the first embodiment, retainer 8 is easily assembled to the housing and can fully insert at least partially inserted terminals, and there are no undesirable contacts between adjacent terminals because there are no lateral forces caused in assembling the retainer to the housing.

The electrical connector according to the first embodiment has been described as having six male terminals, and the electrical connector of the second embodiment has been described as having eight female terminals. This has been done for illustration purposes only. As a matter of course, however, these electrical connectors can be designed to have as many terminals as is required. The number of terminals could range from two to fifteen or more.

FIGS. 23(*a*)–(*d*) show a two-pole electrical connector (without a terminal retainer assembled thereto) which is structurally similar to the electrical connector described above and shown in FIGS. 14–22. Specifically, FIG. 23(*a*) shows the electrical connector in a top plan view; FIG. 23(*b*) shows the connector in a bottom plan view; FIG. 23(*c*) shows the front of the connector; and FIG. 23(*d*) shows the rear of the connector.

FIGS. 24(*a*)–(*d*) shows a three-pole electrical connector (without the terminal retainer). Specifically, FIG. 24(*a*) shows a top plan view of the connector; FIG. 24(*b*) shows a bottom plan view of the connector; FIG. 24(*c*) shows the front of the connector; and FIG. 24(*d*) shows the rear of the connector.

Figure 25:
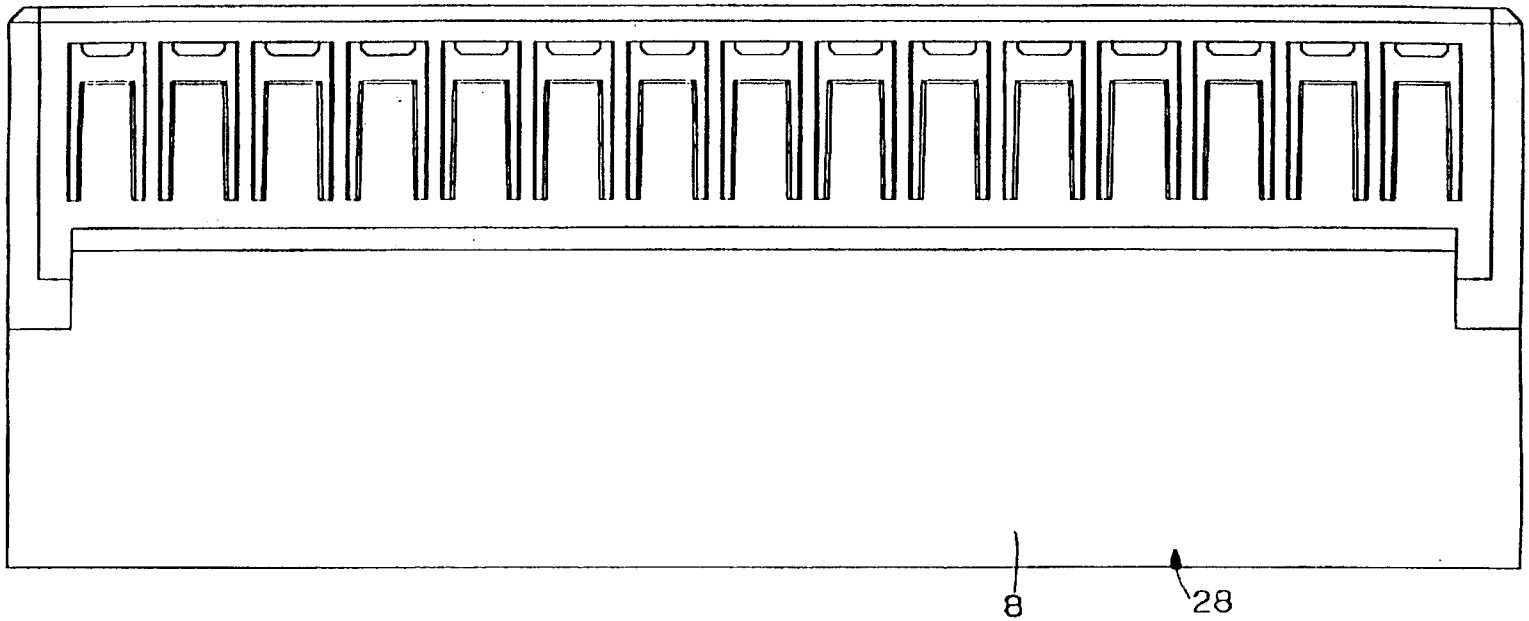
FIGS. 25(*a*) and (*b*) are top plan and front elevational views, respectively, of an electrical connector according to a fifth embodiment of the invention.
Figure 25:
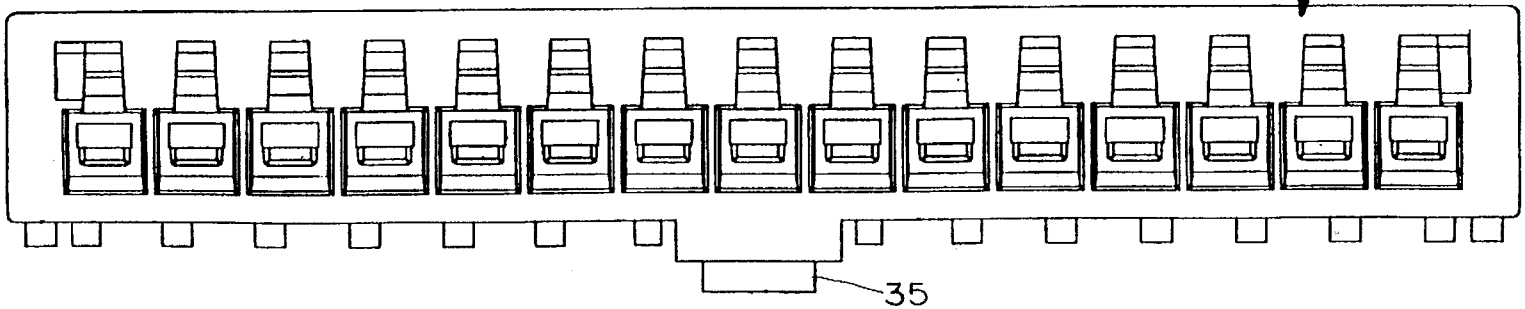
Figure 26A:
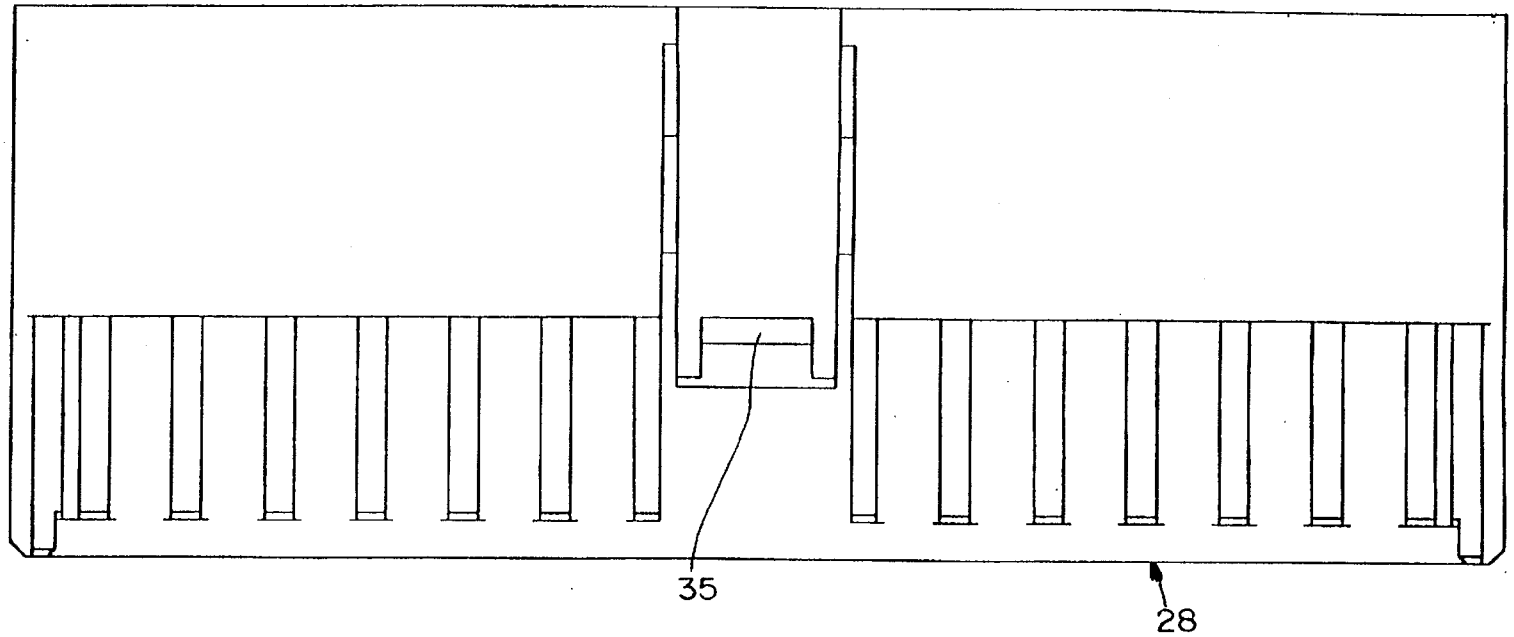
FIGS. 26(*a*) and (*b*) are bottom plan and rear elevational views, respectively, of the fifth embodiment of the invention.
Figure 26B:
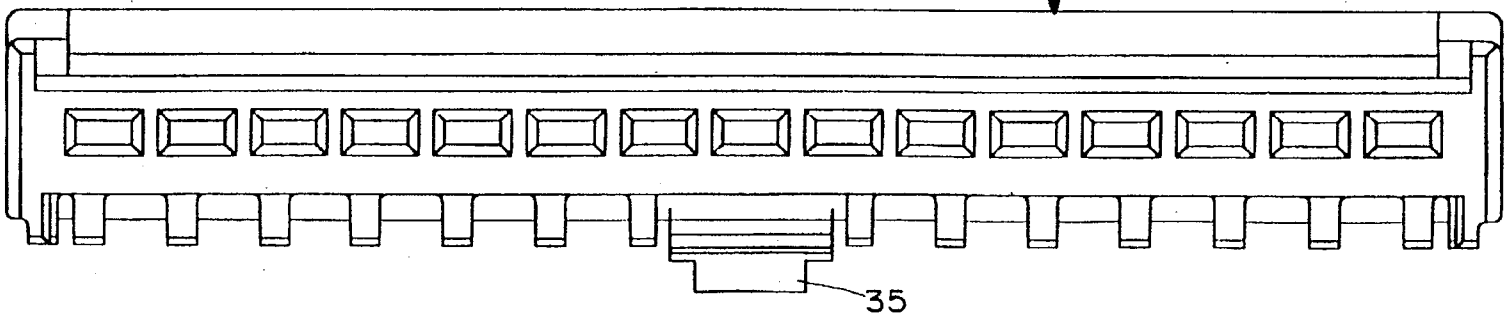

FIGS. 25(*a*) and (*b*) and FIGS. 26(*a*) and (*b*) show a fifteen-pole electrical connector. Specifically, FIG. 25(*a*) shows a top plan view of the connector; FIG. 25(*b*) shows the front of the connector; FIG. 26(*a*) shows a bottom plan view the connector; and FIG. 24(*b*) shows the rear of the connector. The side view of the fifteen-pole connector is similar to FIG. 21.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a housing having a plurality of generally parallel elongated terminal-receiving cavities and an opening in a first side wall of the housing intersecting the cavities and communicating therewith;

a plurality of generally elongated terminals insertable into the cavities, each terminal including a latching projection;

a terminal retainer positionable in the opening in a direction transverse to the cavities, the retainer including a plurality of elongated ribs projecting into a respective one of the cavities and engaging an outer wall of the elongated terminals, adapted to bias the terminals against a side wall of the housing opposite said first side wall and ends of the elongated ribs including camming surfaces for engaging the latching projections on the terminals and moving the terminals to fully inserted positions in the event that the terminals are in only partially inserted positions; and complementary interengaging locking means between the terminal retainer and the housing to lock the retainer in said opening.

2. The electrical connector of claim 1 wherein said opening in the housing and said terminal retainer are elongated in a direction transverse to the elongated cavities, and the terminal retainer is symmetrical in a direction parallel to the elongated terminals to allow the retainer to be positioned in the opening regardless of the orientation of the retainer along said parallel direction.

3. The electrical connector of claim 1 wherein said ends of the elongated ribs are rounded to present curved camming surfaces for engaging the latching projections on the terminals.

4. The electrical connector of claim 3 wherein said latching projections on the terminals are triangulated to present oblique surfaces for engaging the curved camming surfaces.

5. The electrical connector of claim 1 wherein said housing includes a primary latch engageable with a latch surface on each terminal, whereby said latching projections and said camming surfaces comprise secondary latch means.

6. The electrical connector of claim 5 wherein said primary latch and said latch surface are on a side of each terminal opposite the respective latching projection and camming surfaces, whereby each rib is effective to bias the respective terminal toward the primary latch.

7. The electrical connector of claim 6 wherein said primary latch comprises a flexible latch arm cantilevered into a respective terminal-receiving cavity.

8. An electrical connector, comprising:

a housing having a plurality of generally parallel elongated terminal-receiving cavities and an opening in a side wall of the housing intersecting the cavities and communicating therewith;

a plurality of generally elongated terminals insertable into the cavities, each terminal including a latching projection;

a terminal retainer positionable in the opening in a direction transverse to the cavities, the retainer including a plurality of elongated ribs projecting into the cavities and engaging the elongated terminals, and ends of the elongated ribs including camming surfaces for engaging the latching projections on the terminals and moving the terminals to fully inserted positions in the event that the terminals are in only partially inserted positions;

complementary interengaging locking means between the terminal retainer and the housing to lock the retainer in said opening; and said opening in the housing and said terminal retainer are elongated in a direction transverse to the elongated cavities and terminals, and the terminal retainer is symmetrical in the longitudinal direction to allow the retainer to be positioned in the opening regardless of the longitudinal orientation of the retainer.

9. An electrical connector, comprising:

a housing having a plurality of generally parallel elongated terminal-receiving cavities and an opening in a side wall of the housing intersecting the cavities and communicating therewith;

a plurality of generally elongated terminals insertable into the cavities, each terminal including a triangulated latching projection presenting oblique surfaces;

a terminal retainer positionable in the opening in a direction transverse to the cavities, the retainer including a plurality of elongated ribs projecting into the cavities and engaging the elongated terminals, and ends of the elongated ribs being rounded to present curved camming surfaces for engaging the oblique surfaces of the latching projections on the terminals and moving the terminals to fully inserted positions in the event that the terminals are in only partially inserted positions; and complementary interengaging locking means between the terminal retainer and the housing to lock the retainer in said opening.

* * * * *